US009695013B1

(12) United States Patent
Abaie

(10) Patent No.: US 9,695,013 B1
(45) Date of Patent: Jul. 4, 2017

(54) HANDRAIL CARGO SYSTEM AND METHOD THEREOF

(71) Applicant: Abraham Abaie, Phoenix, AZ (US)

(72) Inventor: Abraham Abaie, Phoenix, AZ (US)

( * ) Notice: Subject to any disclaimer, the term of this patent is extended or adjusted under 35 U.S.C. 154(b) by 0 days.

(21) Appl. No.: 15/153,351

(22) Filed: May 12, 2016

(51) Int. Cl.
*B66B 23/00* (2006.01)
*B66B 9/08* (2006.01)
*E04F 11/18* (2006.01)

(52) U.S. Cl.
CPC ..... *B66B 9/0853* (2013.01); *B66B 9/083* (2013.01); *E04F 11/1802* (2013.01)

(58) Field of Classification Search
CPC B66B 23/12; B66B 23/04; B66B 9/08; B66B 9/0861; B65G 17/20; B65G 47/61; E04F 11/18; E04F 2011/1876; B61B 23/12; B61B 23/02
USPC ..... 198/321, 326, 465.4, 678.1, 686
See application file for complete search history.

(56) References Cited

U.S. PATENT DOCUMENTS 4,756,387 A * 7/1988 Grass ..... B66B 9/0815 182/37
5,275,256 A * 1/1994 Ellzey ..... E06C 7/14 104/246
5,476,155 A * 12/1995 Nakatani ..... B66B 9/0853 187/201
7,185,741 B1 * 3/2007 Rozenfeld ..... B66B 9/0869 187/200
2007/0269303 A1 * 11/2007 Quare ..... E06C 7/12 414/785
2008/0093176 A1 * 4/2008 Rosenthal ..... B66B 9/083 187/241
2014/0150354 A1 * 6/2014 Danziger ..... E04F 11/1863 52/29
2016/0115735 A1 * 4/2016 Kummer ..... E06C 7/12 104/118

* cited by examiner

*Primary Examiner* — James R Bidwell
(74) *Attorney, Agent, or Firm* — Weiss & Moy, P.C.; Jeffrey D. Moy

(57) ABSTRACT

The present disclosure relates to a handrail or support assembly for a stairway. More particularly, this disclosure describes a slidable holder or carrier automatically movable along the length of the handrail or support assembly to lift or carry objects for a user from one end of the stairway to another. In one illustrative embodiment, the assembly may include a handrail or support attached to a wall. A trolley assembly may be placed within the handrail or support and slidable along the length the handrail or support. An arm or extension may be coupled to the trolley assembly and connected to a carrier or holder. An actuator may slide or move the trolley assembly up and down the handrail or support assembly. Through the system described above, cargo may be lifted from one level to another level automatically.

16 Claims, 14 Drawing Sheets

HANDRAIL CARGO SYSTEM AND METHOD THEREOF

TECHNICAL FIELD

This disclosure generally relates to a handrail or support assembly, and more particularly, to an automated holder movable along the length of the handrail or support assembly of a stairway to carry objects for a user from one end to another.

BACKGROUND

The lifting or lowering of objects up and down a stairway has long been recognized as a problem for those who live in multi-level buildings. Traversing stairways may take considerable effort as stairways typically come in multiple configurations. For example, steps on a stairway may differ from other stairways. Further, each step may differ from one another on the same stairway.

Carrying objects while traversing the stairway may typically require an understanding of these steps even when a user has a full view of those steps. Difficulties may become more pronounced when the steps are obscured by carried objects. Such scenarios may make the user guess the height and width of each step before lifting or lowering themselves. Those not familiar with the set of steps may have further challenges.

While numerous systems have been designed to solve the problem of lifting or lowering individuals from one level to the next, most such systems have been dedicated to the individual and not to objects carried by the individual. These systems are not adapted to handling objects. The present disclosure provides a handrail cargo system and method thereof that removes the need to physically carry objects up and down stairways. Other benefits will become clear from the disclosure provided herein.

SUMMARY

This summary is provided to introduce a selection of concepts in a simplified form that are further described below in the DESCRIPTION OF THE DISCLOSURE. This summary is not intended to identify key features of the claimed subject matter, nor is it intended to be used as an aid in determining the scope of the claimed subject matter.

In accordance with one aspect of the present disclosure, an assembly is provided. The assembly includes a support attached to a wall, an object holder slidable along the support, and an actuator facilitating movement of the holder along the support.

In accordance with another aspect of the present disclosure, a handrail for a stairway is provided. The handrail includes a track, a trolley assembly having a carrier slidable along the track, and a motor assisting movement of the trolley assembly carrying objects up and down the stairway through the carrier.

In accordance with yet another aspect of the present disclosure, a system for a stairway is provided. The system includes a handrail extending upwards from one level to another level, a carrier having objects movable along the handrail, and an actuator moving the carrier from the one level to the another level lifting or lower the objects.

BRIEF DESCRIPTION OF DRAWINGS

The novel features believed to be characteristic of the disclosure are set forth in the appended claims. In the descriptions that follow, like parts are marked throughout the specification and drawings with the same numerals, respectively. The drawing figures are not necessarily drawn to scale and certain figures may be shown in exaggerated or generalized form in the interest of clarity and conciseness. The disclosure itself, however, as well as a preferred mode of use, further objectives and advantages thereof, will be best understood by reference to the following detailed description of illustrative embodiments when read in conjunction with the accompanying drawings, wherein:

DESCRIPTION OF THE DISCLOSURE

The foregoing description is provided to enable any person skilled in the relevant art to practice the various embodiments described herein. Various modifications to these embodiments will be readily apparent to those skilled in the relevant art, and generic principles defined herein may be applied to other embodiments. Thus, the claims are not intended to be limited to the embodiments shown and described herein, but are to be accorded the full scope consistent with the language of the claims, wherein reference to an element in the singular is not intended to mean "one and only one" unless specifically stated, but rather "one or more." All structural and functional equivalents to the elements of the various embodiments described throughout this disclosure that are known or later come to be known to those of ordinary skill in the relevant art are expressly incorporated herein by reference and intended to be encompassed by the claims. Moreover, nothing disclosed herein is intended to be dedicated to the public regardless of whether such disclosure is explicitly recited in the claims.

Overview

The present disclosure relates to a handrail or support assembly for a stairway. More particularly, this disclosure describes a slidable holder or carrier automatically movable along the length of the handrail or support assembly to lift or carry objects for a user from one end of the stairway to another. In one illustrative embodiment, the assembly may include a handrail or support attached to a wall. A trolley assembly may be placed within the handrail or support and slidable along the length the handrail or support. An arm or extension may be coupled to the trolley assembly and connected to a carrier or holder. An actuator may slide or move the trolley assembly up and down the handrail or support assembly. Through the system described above, cargo may be lifted from one level to another level automatically.

Numerous other modifications or configurations for the handrail or support assembly will become apparent from the description provided below. Advantageously, the handrail or support system presented herein removes the need for lifting or lowering cargo, objects, or other items up and down a flight of stairs. These objects may include, but are not limited to, laundry, a vacuum cleaner, supplies, and the like which are typically brought up and down a stairway in multi-level residences or businesses. Furthermore, through multiple attachments, varying sizes, weights, and shapes of these objects may be lifted or lowered.

The present disclosure will discuss a handrail or support in FIGS. 1 through 4, followed by a description of the wheel trolley and safety or sensor arm in FIGS. 5 through 11. Different wall configurations attached to the handrail or support will be shown in FIGS. 12 and 13 and FIGS. 14 through 17 will show a holder or carrier. FIGS. 18 through 21 will describe a pulley tension system.

Handrail/Support System

Figure 1:
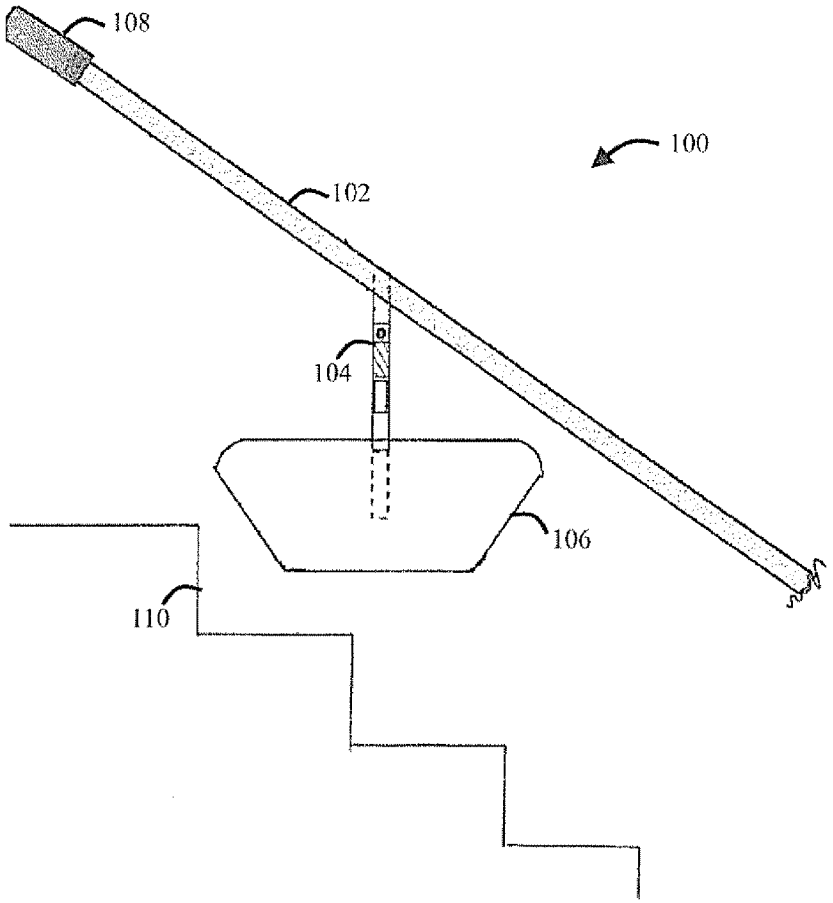
FIG. 1 is a side view of an exemplary handrail or support system having a carrier or holder for moving objects up and down a stairway in accordance with one aspect of the present disclosure.

Turning now to FIG. 1, a side view of an exemplary handrail or support system 100 having a carrier or holder 106 for moving objects up and down a stairway 110 in accordance with one aspect of the present disclosure is provided. The system 100 may have a handrail or support 102. The handrail or support 102 may allow a user to brace themselves while they are traversing up and down the stairway 110. The handrail or support 102 typically begins at a lower level of a stairway 110 and extends to another higher level of the stairway 110. The handrail or support 102 may be securely attached to a wall and follow the incline of the stairway 110. The length of the handrail or support 102 may include one or multiple segments when constructing.

A carrier or holder 106 may be movable or slidably coupled to the handrail or support 102. The carrier or holder 106 may traverse the length of the handrail or support 102 of the system 100. Multiple configurations will be shown for the carrier or holder 106 below. These various configurations for the carrier or holder 106 may allow different sizes and shapes of different objects or other items to be moved along the handrail or support 102.

An arm or extension 104 may be coupled to the carrier or holder 106. The length of the arm or extension 104 may depend on the user. For example, a shorter user may use an arm or extension 104 that is lower to the ground, while a taller user may wish to have a shorter arm or extension 104 so that they would not have to reach low to the ground to obtain their objects. In one embodiment, the arm or extension 104 may be extendable or collapsible. The arm or extension 104 may be retracted through a mechanical or automated lever, not shown.

The arm or extension 104 may traverse the incline of the stairway 110 typically through the handrail or support 102. The length for the arm or extension 104 may be related to the entire height of the arm or extension 104 and the carrier or holder 106 such that the carrier or holder 106 does not contact the stairway 110. While shown as extending downward from the handrail or support 102, the arm or extension 104 may extend down from the handrail or support 102 allowing the carrier or holder 106 to follow the handrail or support 102 at the same distance from the stairway 110 as the handrail or support 102. In one embodiment, the arm or extension 104 may extend above the handrail or support 102.

An actuator 108 may be provided at one end of the handrail or support 102 of the system 100. As shown, the actuator 108 may be provided at the top of the stairway 110, but may be located along the handrail or support 102 or an opposite end. While the placement of the actuator 108 is shown as being along the handrail or support 102, the actuator 108 may be hidden within the wall, or other location of the system 100. The actuator 108 may typically be a motor, however, the actuator 108 may use others forms levers such as magnetics, mechanical cranks, and the like.

While described as being able to move objects or other items from one level to the next on a single stairway 110, the handrail or support system 100 may traverse multiple levels. For example, the system 100 may extend up to more than three levels. Additional hardware may be used depending on how the particular stairway 110 is built.

Figure 2:
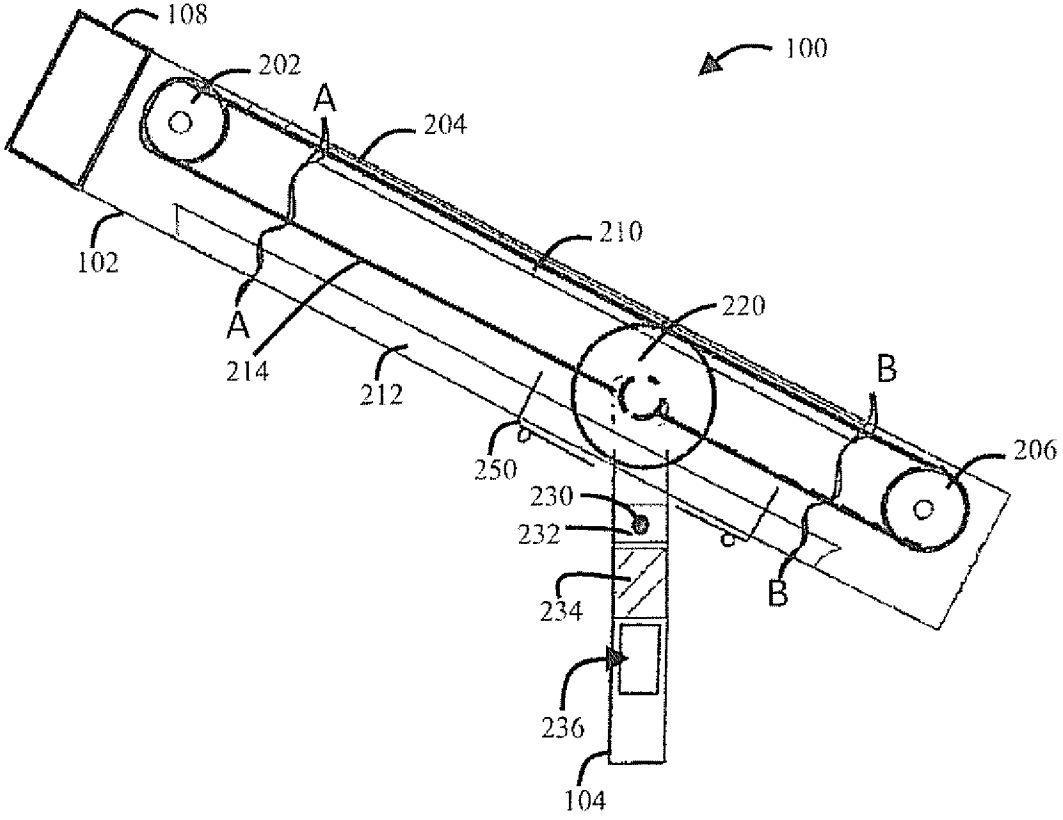
FIG. 2 is a cross sectional side view of the exemplary handrail or support system having the carrier or holder in accordance with one aspect of the present disclosure.

FIG. 2 is a cross sectional side view of the exemplary handrail or support system 100 having the carrier or holder 106 in accordance with one aspect of the present disclosure. The carrier or holder 106, not shown, may be driven up and down and/or back and forth on the handrail or support 102 by a trolley assembly 220. For the purposes of this disclosure, the term object holder may include, but is not limited to, trolley assembly 220, arm or extension 104, and the holder or carrier 106.

The trolley assembly 220, as described earlier, may be connected to the carrier or holder 106 through the arm or extension 104. The arm or extension 104 may include, but is not limited to, at least one retractable cable 230, a protective cushion 232, a safety sleeve 234, and an attachment aperture 236. While each of these will be described in more details below, in part, the retractable cable 230 may attach to the carrier 106 to provide support for the carrier 106 and to prevent the carrier 106 from tipping over when loaded, the protective cushion 232 may surround the retractable cable 230 and provide padding to the retractable cable 230 and to protect objects being carried, the safety sleeve 234 may surround the arm or extension 104 and be pulled down to securely lock into place the carrier or holder 106, and the attachment aperture 236 allows for inserts or attachment assemblies 1404 (see FIG. 14) to be secured to the arm or extension 104.

Turning now to the trolley assembly 220, for which additional details will be provided below, the handrail or support system 100 may drive the trolley assembly 220 through a DC motorized pulley cable system. The system may include a wheel 202 rotated by an actuator 108, for example, a motor. The wheel 202 may move a drive cable 214 which is connected to the trolley assembly 220. A return cable 204 may be attached to the other side of the trolley assembly 220. The cable 204 may be spun around a pulley 206 and back to the wheel 202 driven by the actuator 108.

Surrounding the trolley assembly 220 may be a safety sensor assembly 250. In part, and which will be described in more details below, the safety sensor assembly 250 may prevent movement of the trolley assembly 220 if an object or person is detected within a distance of the trolley assembly 220. Typically, the safety sensor assembly 250 may monitor objects or persons below the handrail or support 102.

A J-shaped channel 210 may guide the return cable 204 back and forth as the trolley assembly 220 is moved. The handrail or support 102 may include a wheel track 212 for guiding the trolley assembly 220. The wheel track 212 provides a surface for the trolley assembly 220 to move along. In one embodiment, the trolley assembly 220 may include teeth that correspond to teeth on the wheel track 212 for better traction.

The motorized pulley cable system may move the trolley assembly 220 within the handrail or support 102. The arm or extension 104 and the carrier or holder 106 may protrude outside the handrail or support 102. Some components of FIG. 2 may extend the length of the handrail or support 102 as indicated by Line A-A and Line B-B which represents that the handrail or support 102 may be extended in either direction. In one example, the drive cable 214 and the return cable 204 may both be extended based on the length of the stairway 110.

While not shown, the handrail or support system 100 may include a controller. The controller may include software, hardware or a combination of software and hardware to provide logic that moves the trolley assembly 220 along the handrail or support 102. The controller may be used to determine whether there is a safety concern through the safety sensor assembly 250. When a certain condition exists, the controller may stop the trolley assembly 220, for example, when an object or person may be in danger by the trolley assembly 220 moving.

In one embodiment, the controller may provide sensing logic for determining whether a user is up or down stairs. The carrier or holder 106 may be automatically moved based on this decision. A user's calendar or typical schedule may be used to calculate whether to bring the carrier or holder 106 up or down on the stairway 110. For example, if a user washes their laundry regularly on Saturday mornings, the system 100 may automatically move the carrier or holder 106 at such time to the top of the stairway 110. In essence, the controller may reduce time for these types of tasks by anticipating a user's needs.

The controller may also be used to activate lights on the handrail or support 102 when detecting a user nearby. The controller may also provide smart sensing for which the arm or extension 104 coupled to the trolley assembly 220 and the carrier or holder 106 may be collapsed or extended. For example, if a ball is located on the stairway 110, the arm or extension 104 may be reduced instead of stopping the entire system 100.

The handrail or support system 100, in one embodiment, may include a remote control that provides commands to the controller. The remote control may use a wireless or wireline connection for providing commands to the controller. Typically, three buttons may be provided, which includes up, down, and on/off for the LEDs.

Figure 3:
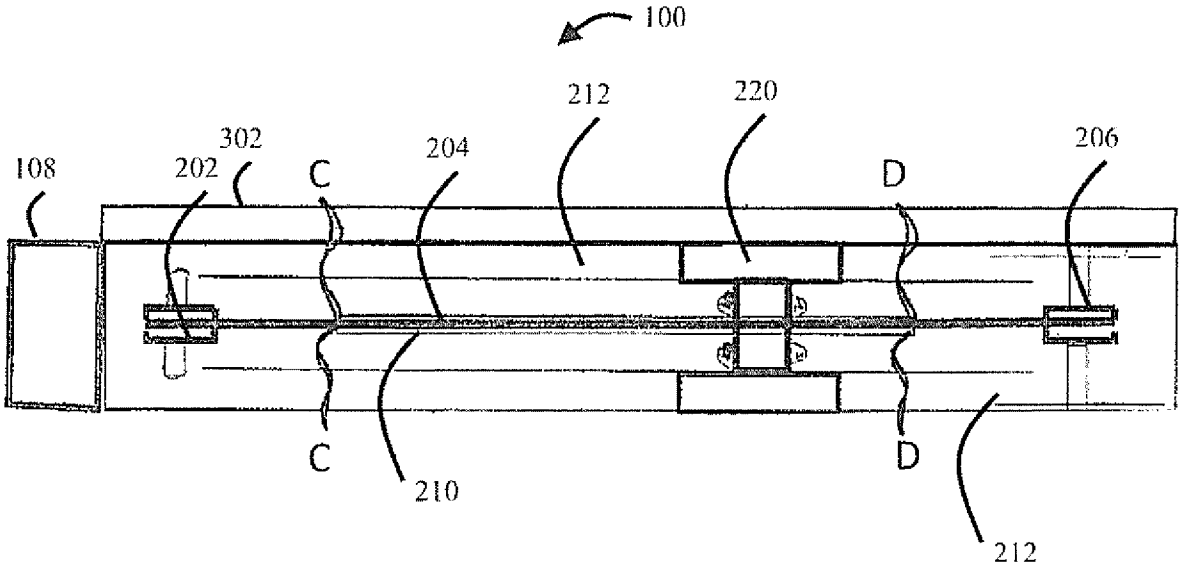
FIG. 3 is cross sectional top view of the exemplary handrail or support system in accordance with one aspect of the present disclosure.

FIG. 3 is cross sectional top view of the exemplary handrail or support system 100 in accordance with one aspect of the present disclosure. The trolley assembly 220, described above, may be moved along the wheel track 212. The track 212, as well as other components, may extend the length of the handrail or support 102 as indicated by Line C-C and Line D-D which represents that the handrail or support 102 may be extended in either direction.

The top view illustrates that the trolley assembly 220 includes at least two wheels. The wheel 202, driven by the actuator 108, may move the trolley assembly 220 through the drive cable 214, return cable 204 and pulley 206 at the opposite end of the actuator 108. Multiple variations may be used, for example, a single wheel trolley assembly 220. More than one pulley 206 and actuator 108 may be used to increase the speed or power of the system 100.

A track extrusion 302 may also be incorporated into the handrail or support system 100. The extrusion 302 may be used to couple the handrail or support system 100 to a wall of the stairway or other fixture. The extrusion 302 may vary in shapes and sizes depending on the individual requirements of the user and their facility. In one embodiment, the extrusion 302 may be made of higher durability materials for business complexes.

Figure 4:
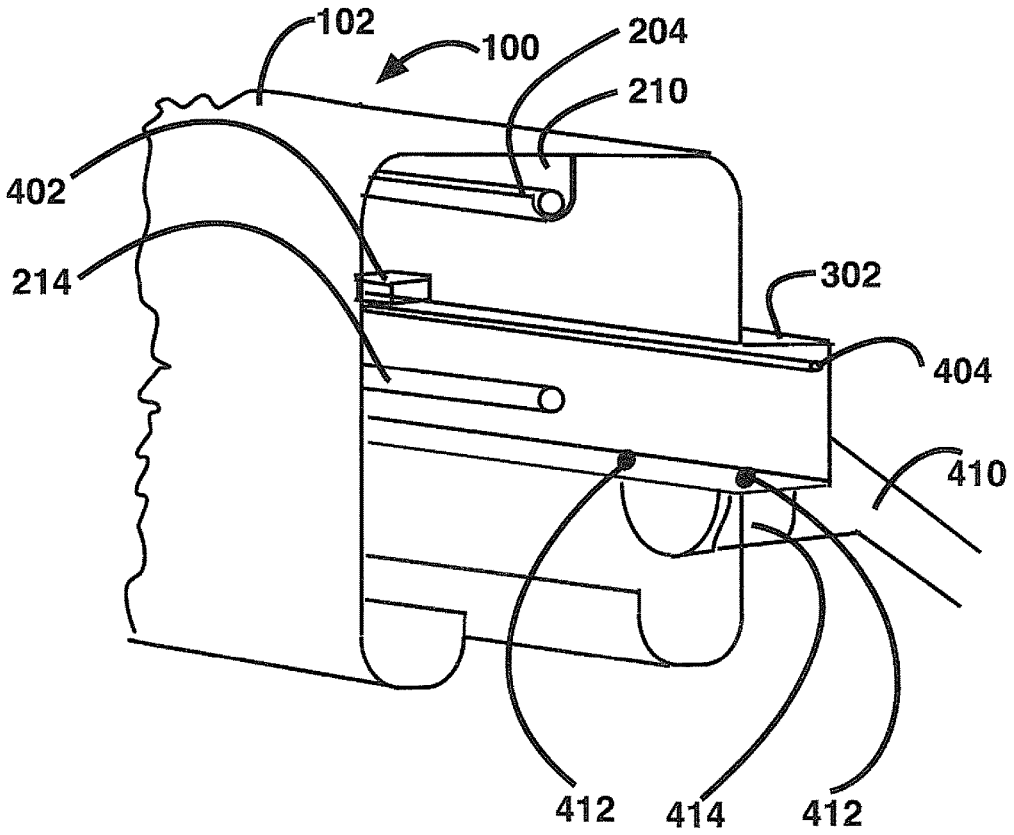
FIG. 4 is sectional side view of a portion of the exemplary handrail or support system showing typical components therein in accordance with one aspect of the present disclosure.

FIG. 4 is sectional side view of a portion of the exemplary handrail or support system 100 showing typical components therein in accordance with one aspect of the present disclosure. For ease of transit to a site, the length of the handrail or support system 100 may be constructed of interconnecting sections of the handrail or support 102. Each section of the handrail or support 102 may be forty-eight inches in length, for example. Sixteen inch wall bracket-spacing 410 may be used on 4-stud installation while twenty-four inch wall bracket-spacing 410 may be used on 3-stud installation.

Curved sections may be provided to accommodate different lengths and shapes of stairways 110 and bends around walls.

Each section of the handrail or support 102 may include a fastening strap 414 and wall bracket 410. These may be used to support the system 100 as well as the system 100 to the wall or other fixture. The fastening strap 414 and wall bracket 410 may be coupled to the track extrusion 302 at one or more locations.

In one embodiment, a light fixture 402 may be coupled to the section of the handrail or support 102. The fixture 402 may be placed externally or internally within the handrail or support 102 such that light may shine only below the handrail or support 102. The light fixture 402 may be a light emitting diode (LED) and may be powered through a wiring 404. When several sections of the handrail or support 102 are tied together, the light fixtures 402 may provide background lighting for the stairway 110. The light fixtures 402 may run the entire length of the system 100.

For installation, each section of the handrail or support 102 may include the J-shaped channel 210, light fixture 402, track extrusion 302, wall bracket 410, nuts 412 and fastener straps 414. The sections may be fitted together aligning the outside of the handrail or support 102, the J-shaped channel 210, and track extension 302. The wiring 404 for the light fixtures 402, return cable 204 along the J-shaped channel 210 and the drive cable 214 may run the entire length of the system 100. To attach each of the sections together and to the wall bracket 410, the fastener nuts 412 and fastener straps 414 may be used.

Trolley Assembly

Figure 5:
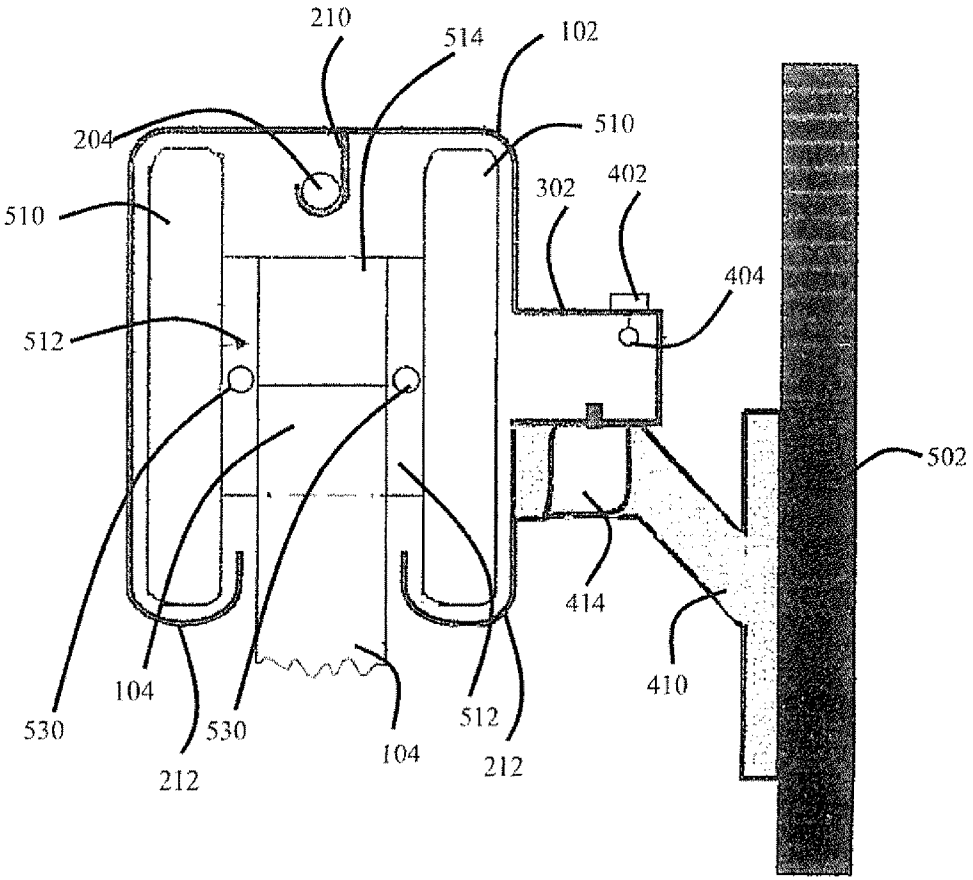
FIG. 5 is front-sectional view of the exemplary handrail or support system showing an illustrative trolley assembly in accordance with one aspect of the present disclosure.

FIG. 5 is a front or end view of the exemplary handrail or support system 100 showing an illustrative trolley assembly 220 in accordance with one aspect of the present disclosure. The trolley assembly 220 may fit entirely within the handrail or support 102. The handrail or support 102, which was described earlier, may be connected to the wall 502 through a track extrusion 302. Coupled to the track extrusion 302 may be a fastener strap 414 and a wall bracket 410. Light fixtures 402 attached to wiring 404 may be provided. The arm or extension 104 coupled to the holder or carrier 106 may be freely rotating allowing the trolley assembly 220 to move freely up or down the stairway 110 and the carrier 106 to remain level.

The J-shaped channel 210 extruded from the interior of the handrail or support 102 provided stabilization movement for the return cable 204. The channel 210 may also provide stability for the wheels 510. For example, the channel 210 may direct the wheels 510 of the trolley assembly 220. This may become valuable when the trolley assembly 220 negotiates a corner or curve of the handrail or support 102 fitted to the stairway 110.

Turning now to specific features, the trolley assembly 220 may include one or more trolley wheels 510, and as shown, two wheels 510. The wheels 510 may move along the wheel tracks 212. The wheel tracks 212 are shaped from the handrail or support 102 curving inwards. The curvature of the tracks 212 may go upwards typically to a point below a middle section of the trolley assembly 220. This may prevent torquing of the trolley assembly 220.

Coupled to the trolley wheels 510 of the trolley assembly 220 may be an axle 512 with attachment nodes 530. The axle 512 may allow for the wheels 510 to rotate while allowing the trolley assembly 220 to be pushed or pulled by the drive cable 214 and return cable 204. The drive cable 214 may be coupled to the attachment nodes 530 of the axle 512. This may allow the trolley assembly 220 to move along the length of the handrail or support 102. The axle 512 may be coupled to a collar 514 and the arm or extension 104, which may be connected to the carrier or holder 106.

Figure 6:
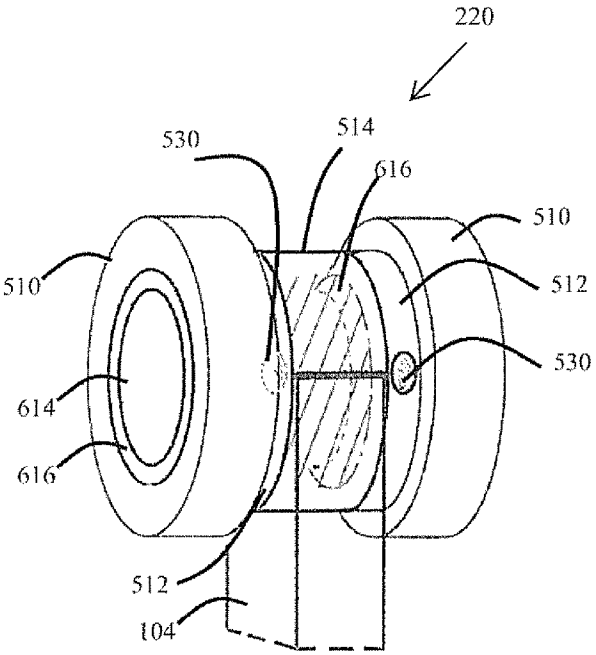
FIG. 6 is side perspective view of the illustrative trolley assembly in accordance with one aspect of the present disclosure.

FIG. 6 is side perspective view of the illustrative trolley assembly 220 in accordance with one aspect of the present disclosure. The drive cable 214 may move the trolley assembly 220 back and forth while maintaining a freely rotating arm or extension 104. The collar 514, described earlier, surrounds the axle 512. Bearing or lubrication 616 (hereinafter bearing 616) may be surrounded by the collar 514 and the arm or extension 104. The combination of the collar 514 and the arm or extension 104 with the bearing 616 may allow the axle 512 to freely rotate and allowing the carrier or holder 106 connected to the arm or extension 104 to remain approximately horizontal.

In one configuration, as shown, the bearing 616 extends through portions of the axle 512. The axle 512 may be pushed or pulled through the wheel track 212 by the drive cable 214 coupled to the attachment nodes 530. Attachment node 530 is in between the sections of the bearings 616. The bearings 616 then extend towards the outer trolley wheels 510. The bearings 616 may allow the wheels 510 to rotate up and down the wheel tracks 212.

The trolley assembly 220 may also include an axle 512. The axle 512 allows the wheels 510 to rotate along the handrail or support 102. The axle 512 may extend underneath the bearing 616 and wheels 510. In one embodiment, the trolley assembly 220 may include its own motor removing the need for the drive cable 214, return cable 204, pulley 206, wheel 202 and actuator 108.

Figure 7:
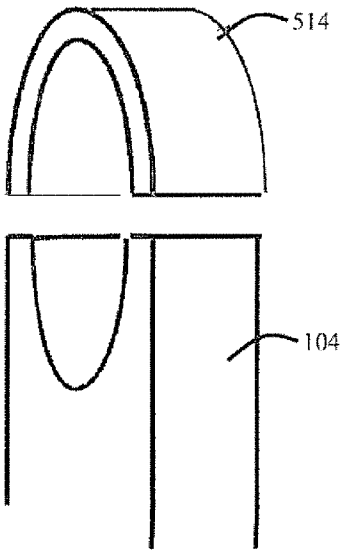
FIG. 7 is side perspective view of an exemplary extension or arm of the illustrative trolley assembly coupled to a collar in accordance with one aspect of the present disclosure.

FIG. 7 is side perspective view of an exemplary extension or arm 104 of the illustrative trolley assembly 220 coupled to a collar 514 in accordance with one aspect of the present disclosure. This configuration may allow for a freely rotating arm or extension 104. While shown as two separate pieces, the collar 514 and the arm or extension 104 may be a single piece.

Figure 8:
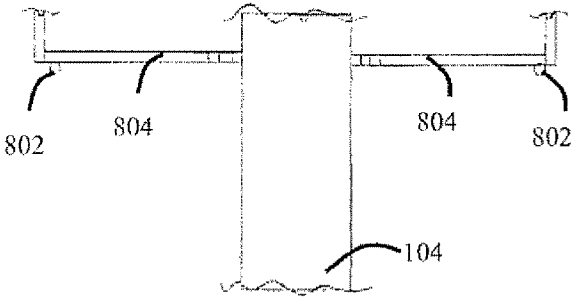
FIG. 8 is view of an exemplary safety sensor assembly surrounding the illustrative trolley assembly in accordance with one aspect of the present disclosure.

Referring to FIG. 8, a side view of an exemplary safety sensor assembly 250 surrounding the illustrative trolley assembly 220 in accordance with one aspect of the present disclosure is provided. The safety sensor assembly 250 may allow for detection of objects or persons in order to stop the trolley assembly 220 from moving up or down the handrail or support 102. Through the controller, described earlier, the actuator 108 may be stopped to prevent movement if certain conditions exist, for example, an object or person is in the way.

In one embodiment, the safety stop provided through safety sensor assembly 250 may be overridden. For example, if the user wishes to walk by their objects and the safety sensor assembly 250 detects a person or object, the stop signal may be removed allowing the trolley assembly 220 to continue. Such scenarios may include large items that need to be held by the user along with the system 100.

The safety sensor assembly 250 may include, but is not limited to, at least one sensor arm 804 extending from the arm or extension 104 and at least one sensor 802 at an end of the at least one sensor arm 804. The safety sensor assembly 250 may be coupled to the trolley assembly 220 at various locations including, but not limited to the arm or extension 104. The arm or extension 104 may provide a stable platform in which objects or persons may be detected. The sensor arms 804 may be a predetermined length determined by which types of objects are to be moved by the system 100. The arms 804 may be extendable in one embodiment.

A sensor 802 at an end of the at least one sensor arm 804 may be used. These sensors may simply detect light differences to determine whether an object or person is in the way. These sensors 802 may detect light pattern changes or differences. Heat sensors may also be used. Alternatively, more sophisticated sensors 802 may be used especially for night time use of the system 100. These sensors 802 may employ computational heavy complex algorithms.

Figure 9:
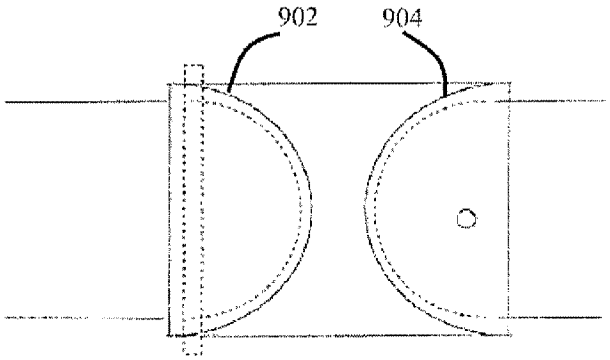
FIG. 9 is a view of an illustrative hinge for the exemplary safety sensor assembly in accordance with one aspect of the present disclosure.

FIG. 9 is a view of an illustrative hinge for the exemplary safety sensor assembly 250 in accordance with one aspect of the present disclosure. The vertical rotation hinge 904 and lateral rotation hinge 902 may provide a stress-free movement of the safety sensor assembly 250 as the trolley assembly 220 moves up and down and around corners of the stairway 110. These hinges 902 and 904 are typically at the intersection of the arm or extension 104 and the sensor arm 804.

Figure 10:
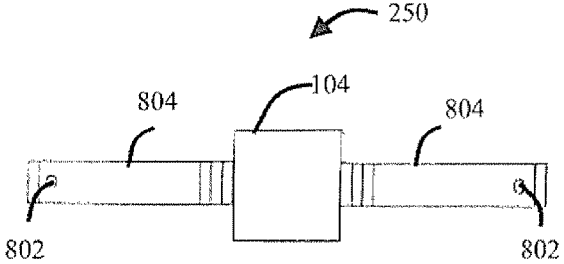
FIG. 10 is a bottom view of the exemplary safety sensor assembly in accordance with one aspect of the present disclosure.

With reference to FIG. 10, a bottom view of the exemplary safety sensor assembly 250 in accordance with one aspect of the present disclosure is provided. The sensors 802 may be placed at the end of the sensor arms 804 that are coupled to the arm or extension 104. In the embodiment shown, the sensors 802 are heat sensors detecting heat emitting sources such as persons or animals on the stairway 110. When detected, the system 100 may stop.

Figure 11:
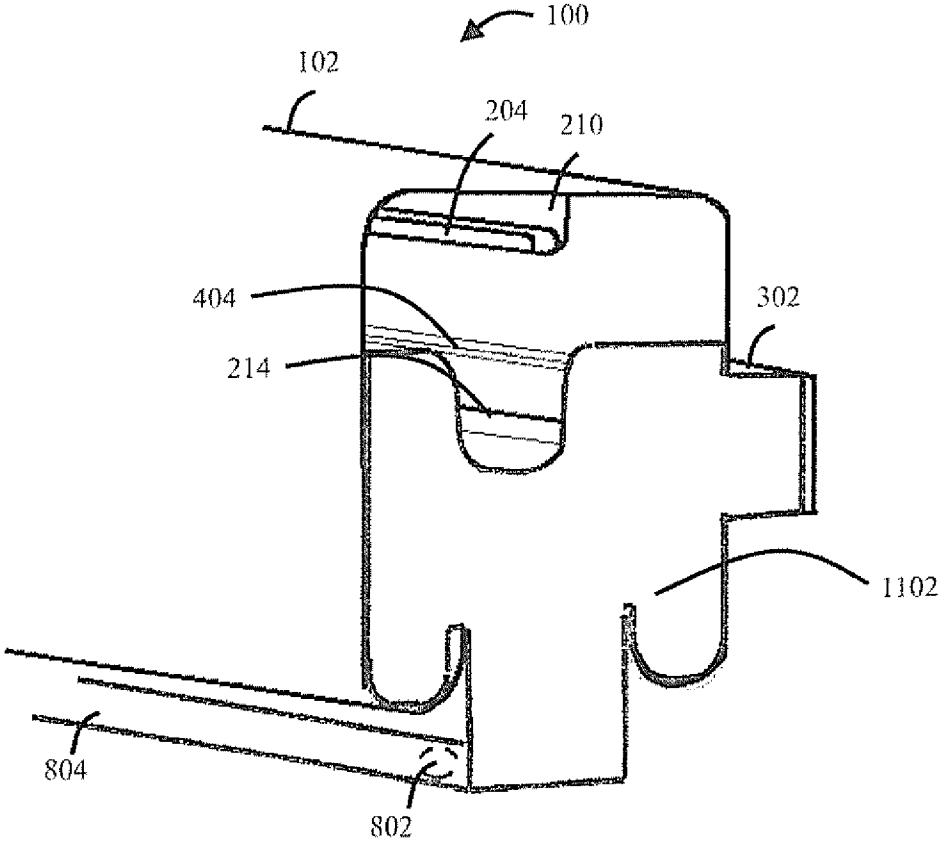
FIG. 11 is sectional side view of a portion of the exemplary handrail or support system showing an illustrative template guide for the safety or sensor arm in accordance with one aspect of the present disclosure.

FIG. 11 is sectional side view of a portion of the exemplary handrail or support system 100 showing an illustrative template guide 1102 for the safety or sensor arm 804 in accordance with one aspect of the present disclosure. The template guide 1102, which may be included on both sides, may ensure a smooth transition of the safety sensor assembly 250 through the handrail or support 102 and may prevent one from inserting objects or body parts in the handrail or support system 100.

The template guide 1102 may be coupled to the sensor arm 804 at an end portion beyond the sensor 802. The shape of the guide 1102 may be that of a lower portion of the handrail or support 102. The shape may cover the wheel tracks 212 and the track extrusion 302. Openings through the guide 1102 may allow for the drive cable 214, wiring 404 for the light fixture 402 and the return cable 204 along with the J-shaped channel 210 to pass there through. In essence, the template guide 1102 is a safety shield blocking items from coming into contact with the trolley assembly 220 and preventing injury.

Wall Configurations

Figure 12:
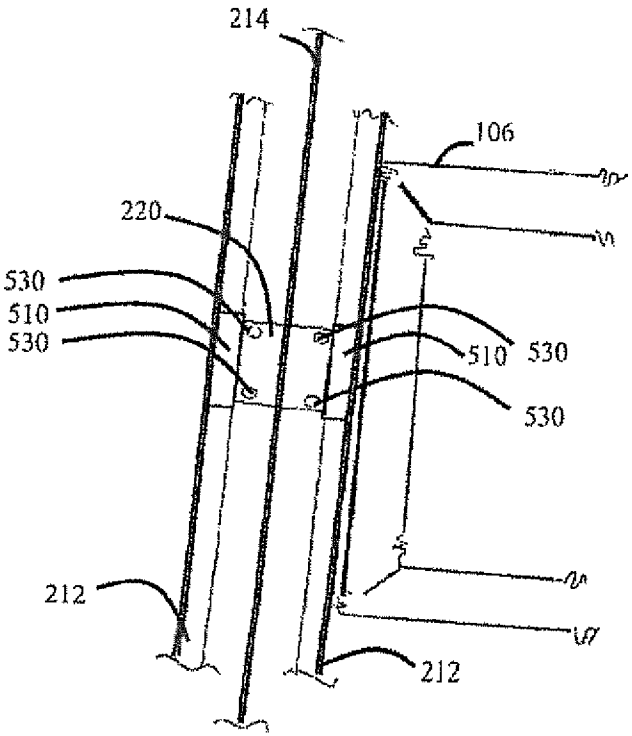
FIG. 12 is top cross sectional view of the exemplary handrail or support system showing an illustrative pulley system for the trolley assembly in accordance with one aspect of the present disclosure.
Figure 13:
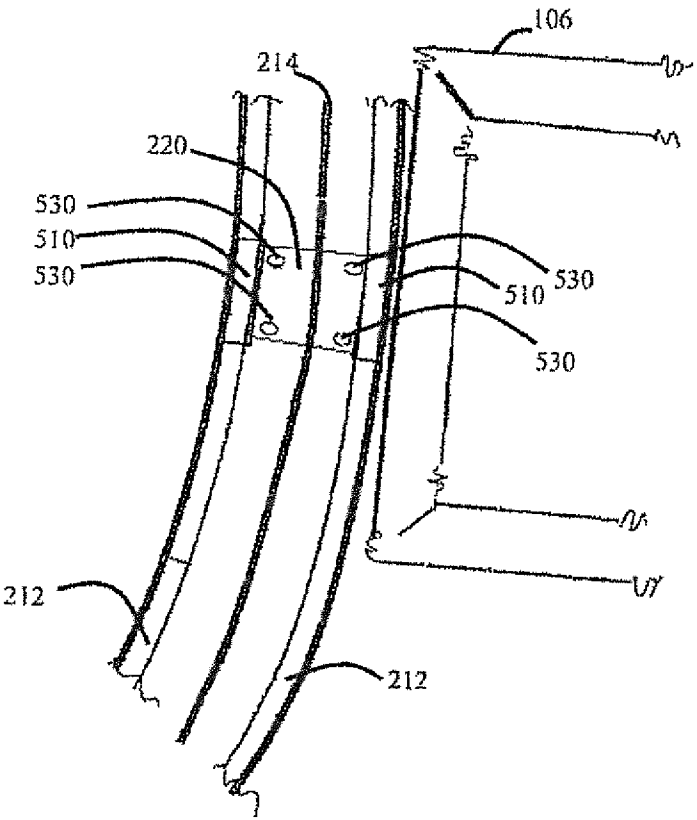
FIG. 13 is top cross sectional view of the exemplary handrail or support system showing the illustrative pulley system for the trolley assembly for a curved wall in accordance with one aspect of the present disclosure.

FIGS. 12 and 13 are top cross sectional views of the exemplary handrail or support system 100 showing an illustrative pulley system for the trolley assembly 220 for a linear and curved wall in accordance with one aspect of the present disclosure. The linear wheel tracks 212 shown in FIG. 12 and curved wheel tracks 212 shown in FIG. 13 provide a guide for the trolley assembly 220 to go up and down a stairway 110. The trolley wheels 510 of the trolley assembly 220 may glide over the tracks 212. The drive cable 214 may be coupled to the attachment nodes 530 to push or pull the trolley assembly 220 up and down the stairway 110. The carrier or holder 106 may come in the form of a basket.

Carriers or Holders

Figure 14:
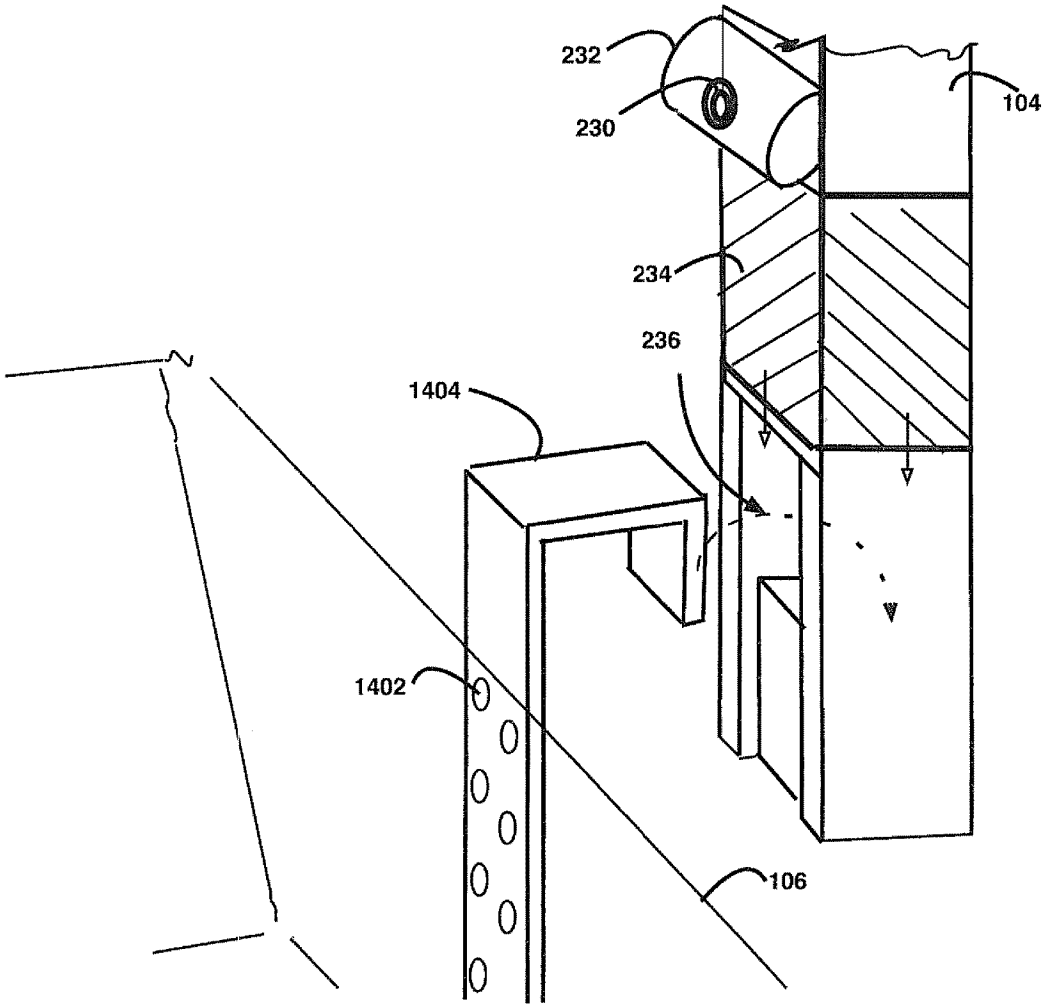
FIG. 14 is top perspective side view of the extension or arm of the illustrative trolley assembly supporting a carrier or holder in accordance with one aspect of the present disclosure.

FIG. 14 is top perspective side view of the extension or arm 104 of the illustrative trolley assembly 220 supporting a carrier or holder 106 in accordance with one aspect of the present disclosure. The extension or arm 104 may be coupled to the trolley assembly 220 through the collar 514 described above.

In one embodiment, the extension or arm 104, starting from top to bottom, may include the protective cushion 232 and the retractable cable 230. The retractable cable 230 may be wound into the arm 104 through a spring loaded recoil mechanism. As the retractable cable 230 is pulled out tension is provided through the recoil mechanism. Other types of recoil mechanism may be incorporated into extension or arm 104 and is not limited to using a spring. The retractable cable 230 may also be locked such that it may not be retracted or pulled out further.

The protective cushion 232 may protect the extension or arm 104 where the retractable cable 230 recoils. For example, a user may have a tendency to let go of the cable 230 causing it to retract at a fast rate. Normally, this rate along with the cable end may cause damage to the system 100. The cushion 232 may reduce injuries to persons as well. The recoil rate may be adjusted.

Below the protective cushion 232 and the retractable cable 230, may be a safety sleeve 234. The sleeve 234 may be used for securing an inserted attachment assembly 1404. The sleeve 234 may fit over the extension or arm 104 and slide up and down it. An attachment aperture 236, below the sleeve 234 in a non-secure configuration, may be used to insert the assembly 1404. The attachment assembly 1404 may be a J-shaped structure. Once inserted in the aperture 236, the carrier or holder 106 may be tightly secured by bringing or sliding the sleeve 234 over the aperture 236.

The carrier or holder 106, as shown in FIG. 14, may take the form of a basket which may include a bottom plane along with four curved upwards flaps for holding objects or items. The attachment assembly 1404 may include at least one fastening node 1402. The nodes 1402 may be used to couple the attachment assembly 1404 with the carrier or holder 106. Fasteners that may be used to secure them together include hook and loop fasteners, nuts and bolts, screw, adhesives and the like.

The carrier or holder 106 may be made of sturdy materials such as wood, plastic, or metal. In one embodiment, the attachment assembly 1404 may be more defined and provide more structure for the carrier or holder 106. For example, the attachment assembly 1404 may include metal brackets at the bottom to fully support the carrier or holder 106.

Figure 15:
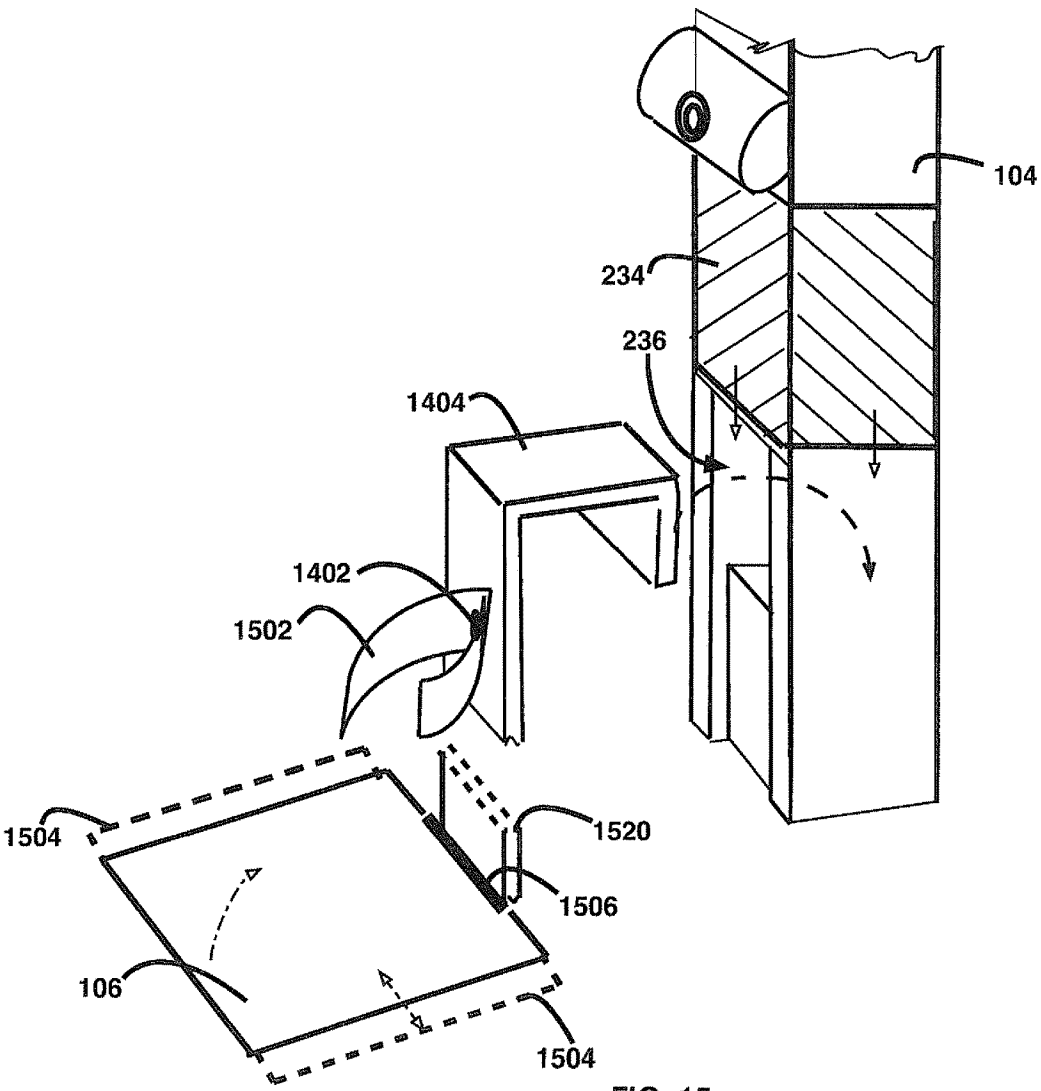
FIG. 15 is top perspective side view of the extension or arm of the illustrative trolley assembly supporting a carrier or holder having an extendable platform in accordance with one aspect of the present disclosure.

Turning to FIG. 15, a top perspective side view of the extension or arm 104 of the illustrative trolley assembly 220 supporting a carrier or holder 106 having an extendable platform in accordance with one aspect of the present disclosure is provided. The carrier or holder 106 may be the extendable platform. The carrier or holder 106 may include, but is not limited to, two extendable platform plates 1504 on the side of the carrier or holder 106. The plates 1504 may flip up or stay horizontal to the carrier or holder 106. A third and fourth plate 1504 may also be provided to fully contain the objects within the carrier or holder 106. The carrier or holder 106 may include a spring 1506 making the carrier or holder 106 fold up if no objects or contents are placed thereon.

An insert 1520 may be used to couple the carrier or holder 106 into the attachment assembly 1404. Securing mechanisms may be used to couple them together, for example, but not limited to, bolts and nuts.

In one embodiment, hook and loop fasteners 1502, attached to attachment assembly 1404 through the fastening node 1402, may be used to secure objects such as vacuum cleaners on the carrier or holder 106. The attachment assembly 1404 secured to the extension or arm 104. The safety sleeve 234 may by lowered to slide over the attachment aperture 236 securely locking the attachment assembly 1404 into place.

Figure 16:
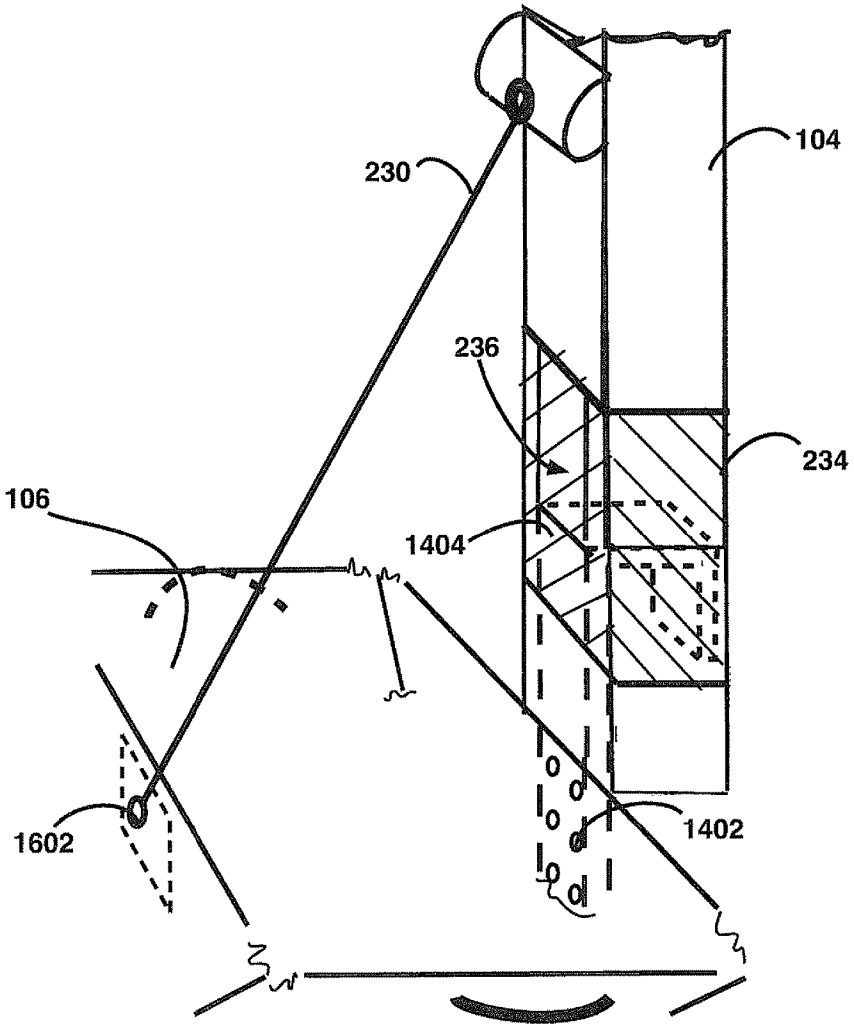
FIG. 16 is perspective view of the extension or arm of the illustrative trolley assembly supporting a carrier or holder secured through a retractable cable in accordance with one aspect of the present disclosure.
Figure 20:
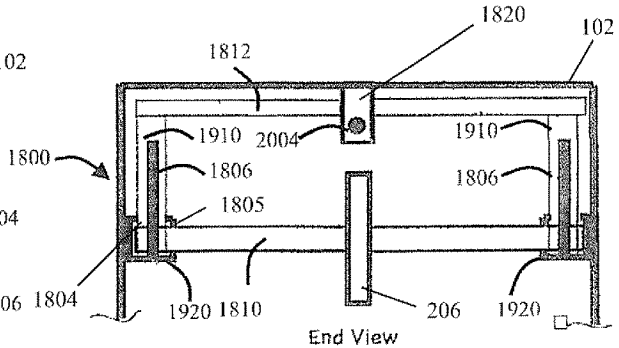
FIG. 20 is an end view of the illustrative pulley tension system in accordance with one aspect of the present disclosure.
Figure 21:
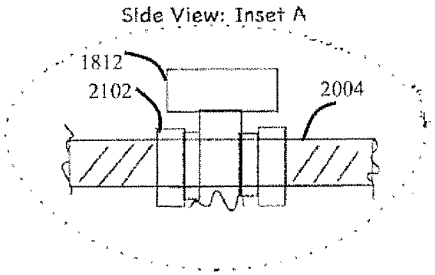
FIG. 21 is a side view of an exemplary inset of the illustrative pulley tension system in accordance with one aspect of the present disclosure.
Figure 18:
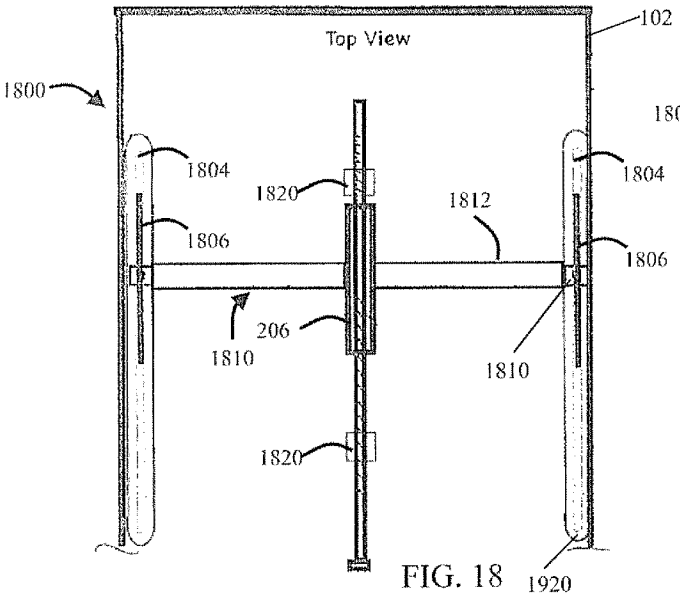
FIG. 18 is top view of an illustrative pulley tension system of the exemplary handrail or support system in accordance with one aspect of the present disclosure.
Figure 19:
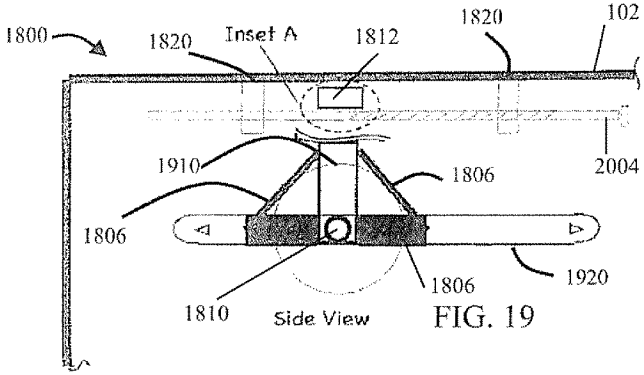
FIG. 19 is side view of the illustrative pulley tension system in accordance with one aspect of the present disclosure.

FIG. 16 is a perspective view of the extension or arm 104 of the illustrative trolley assembly 220 supporting a carrier or holder 106 additionally secured through a retractable cable 230 in accordance with one aspect of the present disclosure. The carrier or holder 106 may be a flat surface and coupled to the attachment assembly 1404 through at least one fastening node 1402.

The attachment assembly 1404 may be secured to the extension or arm 104 placed into the attachment aperture 236 and secured by the safety sleeve 234. The surface of the carrier or holder 106 may be supported by the cable 230. To do this, the user may simply remove the cable 230 and couple or tie it down to an aperture 1602 in the carrier or holder 106.

Figure 17:
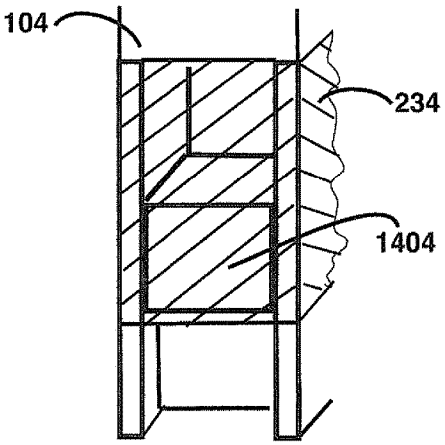
FIG. 17 is rear view of the extension or arm of the illustrative trolley assembly in accordance with one aspect of the present disclosure.

FIG. 17 is a rear view of the extension or arm 104 of the illustrative trolley assembly 220 in accordance with one aspect of the present disclosure. As described above, the safety sleeve 234 may be slide downwards providing safety and security to the attachment assembly 1404.

The embodiments provided above show multiple configurations of a carrier or holder 106 and the support mechanisms to secure them to the extension or arm 104. Other configurations, along with combinations of those described above, may be realized and are within the scope of the present disclosure. In one embodiment, objects or contents with the carrier or holder 106 may be automatically deposited at the top or bottom of the stairway 110. An automated object dump feature may be provided.

In one embodiment, multiple carriers or holders 106 may be placed onto the system 100 at the same time. The drive cable 214 may be able to push and pull multiple wheel trolley assemblies 220 up and down the stairway 110. Further, the carrier or holder 106 may include multiple tiers rather than the single horizontal surface shown above. These tiers may be used to store different items, for example, a key holder may not be the same as a laundry holder. The tiered structure may take advantage of compartmentalization.

Pulley Tension System

Turning to FIGS. 18 through 21, an illustrative pulley tension system 1800 of the exemplary handrail or support system 100 in accordance with one aspect of the present disclosure is provided. The system 1800 may be placed at a distal end from the actuator 108 where the pulley 206 resides. Through the system 1800, the tension on the drive cable 214 and return cable 204 via the overall pulley 206 may be reduced or increased.

The pulley tension system 1800 may include an end cap 1802 (not shown) where adjustments to the system 1800 may be made. The cap 1802 may be secured on through fasteners to the handrail or support 102. The system 1800 may be secured to the handrail or support 102 through support fasteners 1820 and 1920.

Each channel 1920 of the pulley tension system 1800 may include two channel slots 1804 and 1805. Slot 1805 may be used to accommodate translation of the pulley axle 1810 while the slot 1804 may be used to accommodate translation of the vertical shaft 1910 of the bridge 1812. The configuration of the triangular plates 1806 may prevent unnecessary torque. The pulley 206 may be attached to the pulley axle 1810 and goes through the slot 1805. The bridge 1812 is coupled to the vertical shaft 1910 to the pulley axle 1810. A threaded coupler 2102 attached to 1812 may allow the tension adjustment bolt 2004 to adjust the tension of the cable 214 through the pulley 206. As the tension adjustment bolt 2004 is turned to adjust tension, the tension adjustment bolt 2004 traverses through support fasteners 1820 and moves the overall pulley 206 providing tension to the cables 214 and 204.

The foregoing description is provided to enable any person skilled in the relevant art to practice the various embodiments described herein. Various modifications to these embodiments will be readily apparent to those skilled in the relevant art, and generic principles defined herein may be applied to other embodiments. Thus, the claims are not intended to be limited to the embodiments shown and described herein, but are to be accorded the full scope consistent with the language of the claims, wherein reference to an element in the singular is not intended to mean "one and only one" unless specifically stated, but rather "one or more." All structural and functional equivalents to the elements of the various embodiments described throughout this disclosure that are known or later come to be known to those of ordinary skill in the relevant art are expressly incorporated herein by reference and intended to be encompassed by the claims. Moreover, nothing disclosed herein is intended to be dedicated to the public regardless of whether such disclosure is explicitly recited in the claims.

What is claimed is:

1. An assembly comprising:
a support attached to a wall;
an object holder slidable along the support, wherein the object holder comprises:
a wheel trolley;
an arm extending from the wheel trolley; and
a carrier coupled to the arm at a distal end from the wheel trolley; and
a retractable cable fastened to the carrier with the retractable cable extending from the arm; and
an actuator facilitating movement of the object holder along the support.

2. The assembly of claim 1, wherein the support is a handrail.

3. The assembly of claim 1, wherein the wall is curved.

4. The assembly of claim 1, wherein the support is attached to the wall through a wall bracket.

5. The assembly of claim 1, wherein the carrier is coupled to the arm through a bracket secured to an attachment aperture of the arm.

6. The assembly of claim 5, wherein the bracket comprises hook and loop fasteners securing the carrier.

7. The assembly of claim 5, wherein the bracket comprises fastening nodes securing the carrier.

8. The assembly of claim 5, comprising a safety sleeve fitted over the attachment aperture securing the bracket.

9. The assembly of claim 1, wherein the actuator comprises a motor rotating a drive cable and a return cable through a pulley.

10. A handrail for a stairway comprising:
a track;
a wheel trolley having a carrier slidable along the track; and
a motor assisting movement of the wheel trolley carrying objects up and down the stairway through the carrier, wherein the motor rotates a drive cable and a return cable.

11. The handrail of claim 10, wherein the drive cable attaches to at least one node within the wheel trolley.

12. The handrail of claim 10, comprising at least one light source along the track.

13. The handrail of claim 10, comprising a safety sensor assembly around the wheel trolley.

14. The handrail of claim 13, wherein the safety sensor assembly comprises:

at least one sensor arm extending from the wheel trolley; and at least one sensor at an end of the at least one sensor arm.

15. The handrail of claim 14, comprising at least one template guide at an end of the at least one sensor arm.

16. A system for a stairway comprising:

a handrail extending upwards from one level to another level;

a carrier having objects movable along the handrail; and an actuator moving the carrier from the one level to the another level by lifting or lowering the objects; and a pulley and a tension adjustor affecting the actuator moving the carrier.

* * * * *